United States Patent [19]

Goble et al.

[11] 4,143,303

[45] Mar. 6, 1979

[54] SPARK IGNITION CIRCUITS

[75] Inventors: Arthur R. Goble; Michael H. J. Webb, both of Fareham, England

[73] Assignee: Plessey Handel und Investments AG, Zug, Switzerland

[21] Appl. No.: 785,824

[22] Filed: Apr. 8, 1977

[30] Foreign Application Priority Data

Apr. 9, 1976 [GB] United Kingdom ..... 14670/76

[51] Int. Cl.[2] ..... H05B 37/00; H05B 39/00; H05B 41/14

[52] U.S. Cl. ..... 315/239; 313/352; 315/311

[58] Field of Search ..... 431/264; 315/135, 136, 315/206, 237, 238, 239, 240, 352, 353; 313/218, 311, 346 R, 224

[56] References Cited

U.S. PATENT DOCUMENTS

| | | | |
|---|---|---|---|
| 1,965,587 | 7/1934 | Foulke | 176/122 |
| 3,377,125 | 4/1968 | Zielinski | 431/74 |
| 3,813,581 | 5/1974 | Hewitt | 317/96 |

*Primary Examiner*—Alfred E. Smith
*Assistant Examiner*—Robert E. Wise
*Attorney, Agent, or Firm*—Fleit & Jacobson

[57] ABSTRACT

A spark ignition circuit comprising a first capacitor arranged to be charged from a mains power supply through rectifying means and discharged through the primary of a transformer to produce sparking across a spark gap in the secondary circuit of the transformer in response to the operation of a triggerable switching means under the control of a timing circuit connected across the first capacitor and including a second capacitor, the charge voltage of which when it exceeds a predetermined level causes an arc discharge device to break down and the triggerable switching means to be triggered. When the triggerable switching device conducts, the first capacitor will be discharged. The circuit will continue to produce sparks at a rate determined by the timing circuit until such time as gas in the vicinity of a spark gap is ignited. Flame sensing and re-ignition facilities may also be provided. Examples of suitable arc-discharge devices are also disclosed.

5 Claims, 2 Drawing Figures

SPARK IGNITION CIRCUITS

Figure 1:
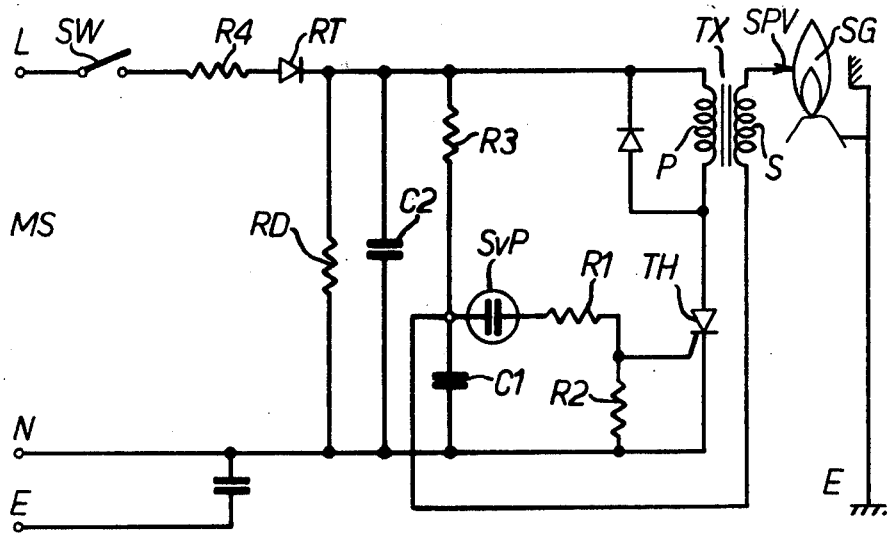

This invention relates to spark ignition circuits which may be used in gas cookers and other gas-fired appliances for the ignition of gas at the burner of the appliance.

A known spark igniter for gas burners, described for example in U.S. Pat. No. 3,813,581, comprises a first capacitor arranged to be charged from a mains power supply through rectifying means and discharged through the primary of a transformer to produce sparking across a spark gap in the secondary circuit of the transformer in response to the operation of a triggerable switching means under the control of a timing circuit connected across the first capacitor and including a second capacitor the charge voltage of which when it exceeds a predetermined level causes a gas-discharge device such as a neon lamp, to break down and trigger switching means. When the triggerable switching device conducts, the first capacitor will be discharged. The circuit will continue to produce sparks at a rate determined by the timing circuit until such time as gas in the vicinity of the spark gap in the secondary circuit of the transformer is ignited. A flame sensing arrangement may be provided in such spark ignition circuits whereby the change in resistance of the spark gap consequent upon the ignition of gas prevents the charge voltage on the second capacitor attaining a value that would otherwise render the discharge device conductive and produce a repeated sparking operation, while on the other hand re-ignition of gas is produced should the burner accidentally be extinguished during operation of the gas cooker or other appliance concerned.

The present invention has for an object to provide an improved spark ignition circuit which enables an increased amount of energy from the first capacitor to be discharged in each spark.

Another object is to provide an improved ignition circuit in which a regular spark-repitition frequency can be more readily maintained.

These and other objects are achieved according to the invention by the feature that the discharge device employed in the timing circuit is, in contrast to the glow-discharge device employed in the known arrangement, an arc-discharge device in which, when the voltage applied reaches the break-down or striking value, discharge takes place in the form of an electric arc, the resulting arc-discharge current being far greater than the ionisation glow-discharge current which passes through a glow-discharge device when its striking voltage is reached, and the minimum voltage required for maintaining the arc-discharge being a very much lower percentage of the striking voltage than the discharge maintaining voltage in the case of an ionisation-discharge device.

Arc-discharge devices which can be used in the circuit according to the invention are not novel. They have previously been used for the protection of electrical apparatus, such as telecommunication equipment, against damage by voltage surges and are, for this reason, generally known as surge-voltage protector or briefly SVP.

The enclosed arc-discharge device of the circuit according to the invention may comprise two electrodes defining a spark gap between them and each being formed from a first portion consisting of a length of metal (e.g. nickel) wire having a melting point temperature of at least 1200° C. coated with barium strontium carbonate and/or oxide and a second portion consisting of a length of wire (e.g. copper clad), having an expansion coefficient compatible with that of the first portion, the first and second portions being secured together in alignment. The said electrodes are sealed within an evacuated enclosure member in such manner that the first portions thereof are enclosed by the enclosure member in a spaced-apart and overlapping relationship, and that the second portions are sealed into a wall of the enclosure member and project therefrom, the enclosure member being filled with gas for example argon having a Paschen minimum equal to or less than 200 volts.

In an alternative form of the spark gap device, the electrodes co-operating within a gas-filled enclosure to define a spark gap, are coated with a halide material, such as cesium chloride, to provide the electrodes with an electron emissive coating.

Figure 2:
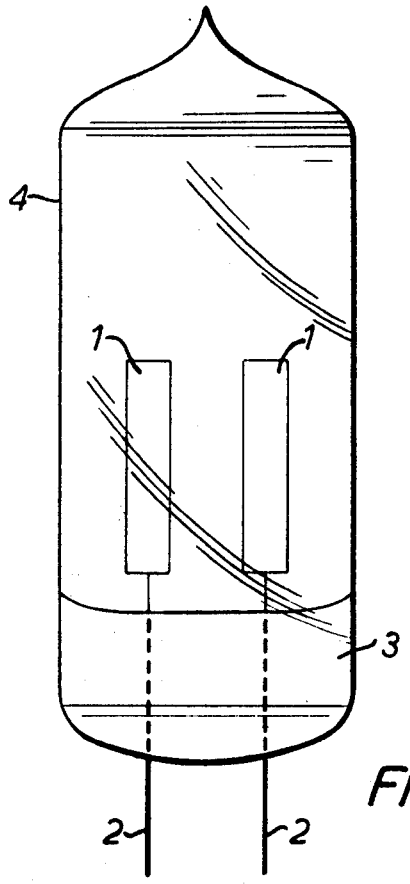

By way of example the present invention will now be described with reference to the drawings in which;

FIG. 1 shows a circuit diagram of a gas ignition circuit having gas re-ignition facilities; and FIG. 2 shows a diagram of an enclosed arc-discharge device used in the circuit of FIG. 1.

Referring to FIG. 1 of the drawing the circuit comprises a capacitor C2 connected to be charged from a mains supply MS through a resistor R4 and half-wave rectifier RT when switch SW is closed. A very-high-value resistor RD is connected across the capacitor C2 to allow gradual full discharge of the capacitor C2 when the circuit is not in use. Also connected across the capacitor C2 is a timing circuit consisting of a capacitor C1 in series with a resistor R3, and the junction of the resistor R3 and capacitor C1 is connected to the trigger electrode of a thyristor TH via an arc-discharge device SVP illustrated in FIG. 2 of the either of the forms above described, in series with a resistor R1.

In operation of the circuit upon closure of switch SW the capacitor C2 will charge up as will the capacitor C1 until the voltage at the junction of capacitor C1 and R3, and if there is no flame at the burner, the latter voltage will reach the striking voltage value of the arc-discharge device SVP whereupon an arc is struck between the electrodes of the arc discharge device SVP, and the resulting current flow thru resistors $R_1$ and $R_2$ causes a voltage to be applied to the trigger electrode of thyristor TH which causes the latter to conduct. As a result, capacitor C2 commences to discharge through the conducting thyristor TH and the primary winding P of step-up transformer TX. The voltage produced in the secondary winding S of the transformer causes a spark for the ignition of gas to be produced between this spark electrode SPV and an earthed burner and the resulting arc will be maintained until either the capacitor $C_2$ has been discharged to the low voltage required to maintain the arc, or the discharge of timing capacitor $C_1$ for the arc-discharge device SVP has reduced its voltage below the value required to maintain the arc in that device.

Once a flame has been produced and as long as such flame remains burning, the resistance of the flame path across the spark gap SG is reduced, bringing the junction of the capacitor C1 and resistor R3 significantly nearer to earth potential and thereby prevents the arc-discharge device SVP from striking. It will be readily appreciated that, because of the much higher current flow and the much lower maintainance voltage, the use of an arc-discharge device SVP instead of a neon lamp has the advantage that a much higher proportion of the energy from the timing capacitor C1 is available to trigger the thyristor TH and therefore sensitive types.

Moreover, because of the high energy utilisation the duration of the triggering pulse to thyristor TH can be made much longer than with a corresponding circuit using a neon glow discharge device instead of the device SVP. When this period is made to exceed the period of the discharge of the capacitor C2 through the thyristor TH, then the circuit avoids a problem that has been experienced with a spark-ignition control circuit employing a neon glow-discharge device, namely, the problem that an uncontrollable amount of energy from the discharge of capacitor C2 is liable to be fed back via the transformer secondary winding S into the timing capacitor C1, the neon device having reverted to its non-conducting state before the discharge of capacitor C1 were complete. In the case of the invention, however, the arc-discharge device SVP will still be conducting after the capacitor C2 has been discharged and hence any energy fed back would be dissipated by the resistors R1 and R2 and not stored in the timing capacitor C1. This advantage enables the starting point for the next cycle of operations to be more closely controlled.

The availability in the timing circuit, of a higher proportion of the energy from the timing capacitor C1 also extends the choice of thyristor to include less sensitive types. Adjustment to suit different sensitivities can be made by selection of the values of the two resistors R1 and R2.

Because an arc-discharge device SVP can easily be made for high striking voltages compared with a maximum of just over 100 volts in the case of neon glow discharge devices working in the normal glow mode, the choice of striking voltage for the arc-discharge device SVP of a circuit according to the invention can be made such that the value of timing resistor R3 may be considerably lower than with a corresponding circuit using a glow discharge device. Typically, while with such corresponding circuit the value of resistor R3 could be as high as 150 megohms, in the circuit of the present invention, it need only be 40 megohms. The latter therefore has the advantage that the lower value of resistor R3 enables a more stable, cheaper and more readily obtainable resistor to be used.

It will also be appreciated that the use of an arc-discharge device of the SVP type in the timing circuit of a spark-ignitor allows considerable saving in manufacturing costs to be effected.

FIG. 2 of the drawings illustrates one constructional form of arc-discharge device which may be employed to constitute the device designated SVP in FIG. 1. It comprises two electrodes each of which may consist of a portion 1 constituted by a length of wire (e.g. nickel) coated with barium strontium carbonate and/or oxide and a portion 2 consisting of a length of wire (e.g. copper clad dumet) and secured to the portion 1 as by butt welding. The portions 2 of the electrodes are sealed by a pinch seal 3 into an enclosure member 4 made of glass. The portions 1 of the electrodes are enclosed by the enclosure member 4 in spaced-apart and overlapping relationship.

Alternatively, the portion 1 of each electrode may be composed of nickel or titanium wire coated with cesium chloride and the portion 2 may consist of a length of nickel or titanium wire welded to the portion 1.

As will be appreciated from the foregoing description of one embodiment of the invention, the use, according to the invention, of an arc discharge device SVP which has the characteristic that the percentage ratio of its maintaining voltage to its striking voltage is very much lower than in the case of a glow-discharge device as used in hitherto known spark-igniter circuits for gas burners, gives a much better stability of operation and a more predictable rate of sparking of the igniter circuit.

What we claim is:

1. Spark ignition circuit for a gas igniter, comprising: a first capacitor; voltage-supply means for connection to a mains supply for supplying d.c. charging current to this capacitor, said voltage-supply means including rectifier means; a step-up transformer having a primary and a secondary winding; a discharge circuit for said first capacitor, including said primary winding in series with a triggerable switching means; an ignition spark-gap connected across said secondary winding; a timing circuit for the triggering of said switching means, said timing circuit including a second capacitor connected, in series with a timing resistor, across said voltage-supply means, and further including an enclosed arc-discharge device, the voltage across said second capacitor being applied to said triggerable switching means through said enclosed arc-discharge device to trigger said switching means when the striking voltage of said arc-discharge device is reached, said arc-discharge device comprising two electrodes defining a spark gap between them, each electrode being formed from a first portion consisting of a length of metal wire having a melting point temperature of at least 1200° C., coated with barium-strontium carbonate and/or oxide, and a second portion consisting of a length of wire having an expansion coefficient compatible with that of the first portion, said first and second portions being secured together in alignment, the said electrodes being sealed within an evacuated enclosure member in such manner that the first portions of the two electrodes are enclosed by the enclosure member in a spaced apart and overlapping relationship and their second portions are sealed into a wall of the enclosure member and project therefrom, the enclosure member being filled with gas having a Paschen minimum equal to or less than 200 volts.

2. An ignition circuit as claimed in claim 1, in which the first portion of each electrode is of a material chosen from the group of material consisting of nickel and titanium.

3. An ignition circuit as claimed in claim 1, in which the arc-discharge device comprises electrodes cooperating within a gas-filled enclosure to define a spark gap, said electrodes being coated with a halide material, such as cesium chloride, to provide the electrodes with an electron-emissive coating.

4. An ignition circuit as claimed in claim 3, in which the first portion of each electrode is of a material chosen from the group of materials consisting of nickel and titanium.

5. An ignition circuit as claimed in claim 1, in which the enclosed arc-discharge device includes an enclosure member filled with argon gas.

* * * * *